United States Patent [19]

Schenkl

[11] Patent Number: 4,702,255

[45] Date of Patent: Oct. 27, 1987

[54] ORTHOPEDIC APPARATUS

[76] Inventor: Joseph L. Schenkl, 2131 Jackson St., Hollywood, Fla. 33020

[21] Appl. No.: 745,861

[22] Filed: Jun. 17, 1985

[51] Int. Cl.[4] ..... A43B 7/14; A43B 7/22

[52] U.S. Cl. ..... 128/586; 36/44; 36/91; 128/80 D; 128/589; 128/600; 128/615; 128/621; 128/622

[58] Field of Search ..... 128/586, 80 D, 596, 128/589, 600, 615, 621, 622; 36/44, 86, 91

[56] References Cited

U.S. PATENT DOCUMENTS

| | | | |
|---|---|---|---|
| 1,710,831 | 4/1929 | Madinger | 128/609 |
| 2,500,591 | 3/1950 | Watkins et al. | 36/71 |
| 2,807,102 | 9/1957 | Sheppard | 36/71 |
| 3,265,071 | 8/1966 | Kirchner et al. | 128/586 |
| 4,232,457 | 11/1980 | Mosher | 36/48 |
| 4,346,525 | 8/1982 | Larsen et al. | 128/586 X |
| 4,413,430 | 11/1983 | Brown | 36/44 |
| 4,572,196 | 2/1986 | Prahl | 128/586 X |

OTHER PUBLICATIONS

Patent Application Ser. No. 278,605 titled "Thin, Light--Weight Flexible Orthopedic Device", by Bruce Friedlander, et al, now U.S. Pat. No. 4,360,027.

*Primary Examiner*—Charles A. Pearson

*Assistant Examiner*—Moshe I. Cohen

*Attorney, Agent, or Firm*—Richard M. Saccocio

[57] ABSTRACT

An orthotic for controlling the motion of and supporting the foot of a person is disclosed. The flexural strength of the orthotic is variable or adjustable. The means to achieve the variable flexural strength is primarily located under the medial arch portion of the orthotic. A thinner rigid orthotic and a thinner semiflexible orthotic are thereby achieved, neither of which rely upon the arch portion of the shoe of the wearer for support. The thinness of the orthotic provides for a low fit within the shoe resulting in a proper fit of the person's foot within the shoe. In one embodiment, a formed shell of two layers of plastic of contrasting colors is machined to remove a substantial amount of the bottom layer primarily along the lateral side thereby leaving a thickened portion at the medial arch portion. Heel and forefoot posts are machined into the bottom layer. In another embodiment, thin strips of plastic are heat welded to the medial underside of a formed shell of plastic. More strips may be added to increase the shell's rigidity; the strips may be ground or removed to decrease rigidity. The strips may be added or removed in whole or in part at any location. The plastic strips may be used as heel or forefoot posts. Replaceable posts may be used with the orthotic.

29 Claims, 14 Drawing Figures

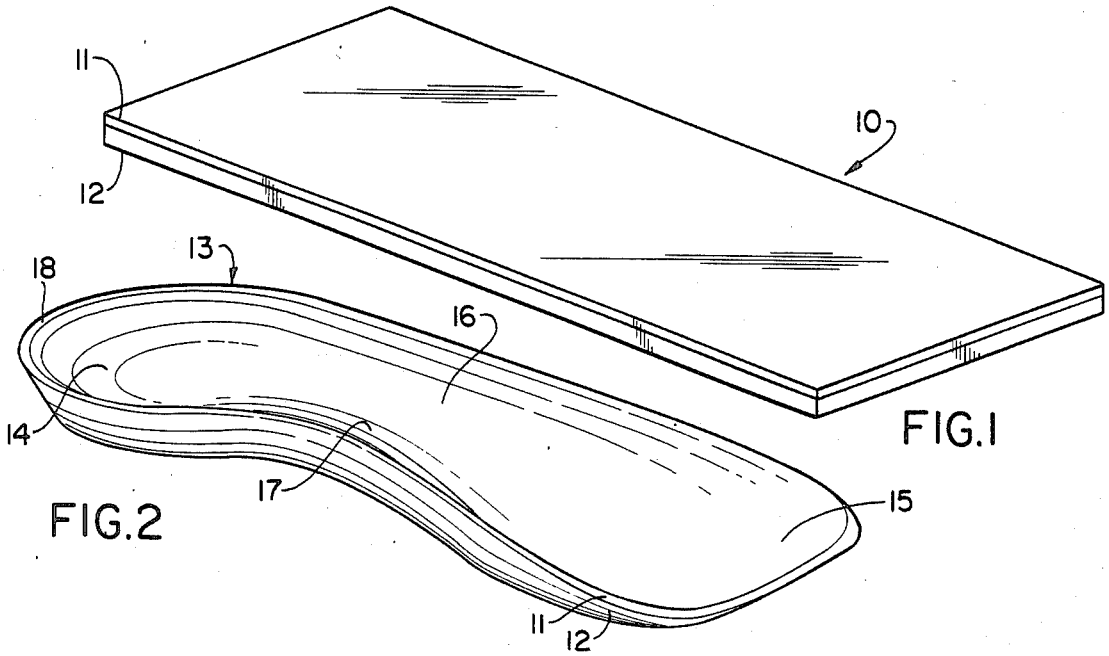
FIG.1
FIG.2
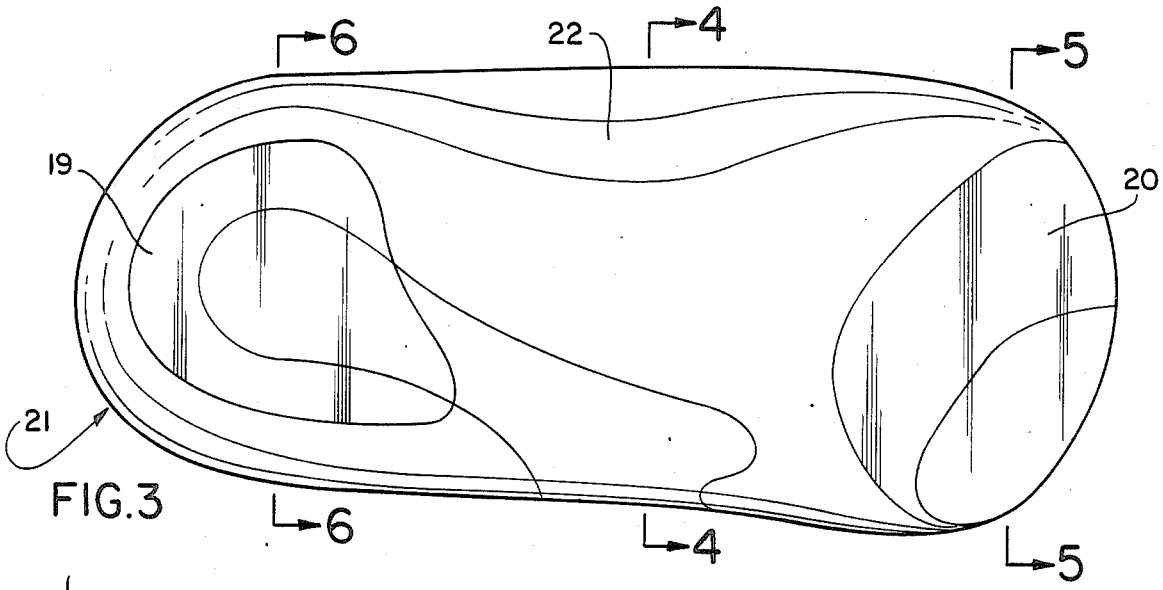
FIG.3
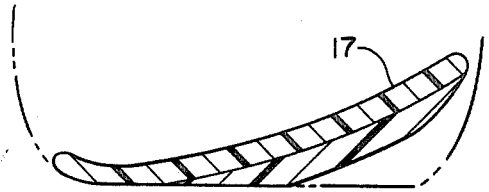
FIG.4
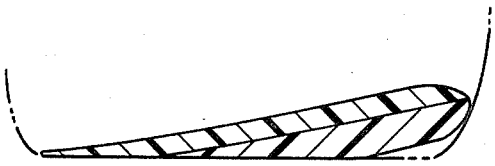
FIG.5
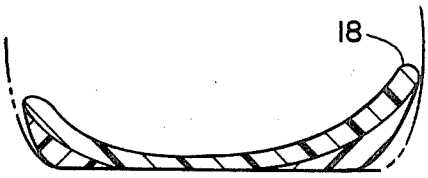
FIG.6

ORTHOPEDIC APPARATUS

BACKGROUND OF THE INVENTION

1. Field of the Invention

This invention relates in general to the field of orthopedic apparatus and in particular to the field of orthopedic therapeutic foot supports or those now commonly called orthotics.

2. Description of the Prior Art

In general, the primary purpose of orthotics is to limit the complex motions of excessive and/or ill-timed pronation and to a lesser extent, supination. Simplified, pronation is the flattening or rolling inward of the foot as the foot strikes the ground such as when walking, running, as the foot is pushing down on the pedal of a bicycle, or as the foot is moving down when a skier is negotiating a bump on the ski slopes. A weak foot will experience excessive pronation during such mild activities as walking or even standing; while a strong foot will experience excessive pronation during vigorous sports activities. Supination, on the other hand, is the rolling outward of the foot. When either or both of these motions become excessive or ill-timed, destructive changes to the foot, ankle, legs, and knees can occur.

The present state of the art in orthotic devices may be broken down into two basic categories: rigid and semiflexible.

Rigid orthotics rely on their own strength and rigidity in controlling the movements of a foot. Early rigid orthotics were made from sheet steel and later aluminum, which was hammered into shape to conform to the patient's foot. Laminated fiberglass was also used somewhat later by being laid up against a cast of a foot and then covered with a material such as leather. The latest rigid type of conventional orthotic devices are generally manufactured from an acrylic thermoplastic material. Such orthotics can be prefabricated in various shoe and arch sizes or custom made to plaster impressions of a foot. Acrylic thermoplastic materials have been used because of their ability to be shaped or molded using sheet stock as the raw material and because of their strength. Such materials are, however, hard and brittle. These latter two traits have resulted in wearer discomfort and sometimes breakage. Attempts to overcome the breakage problem included using a thicker sheet of material and/or laminating a thickness of fiberglass to the molded orthotic. Neither of these solutions has been satisfactory because of the increased thickness of the resulting orthotic which undesirably raises the foot within the shoe containing the orthotic device.

When it is necessary to correct or slightly adjust the control afforded by a rigid orthotic, a device known as a post is used. A post adds a small amount of material or a pad, which often comprises a dental acrylic material, which is bonded to the underside of the orthotic device where it contacts the shoe. The brittle nature of commonly used dental acrylic further affects the breakage problem noted above in that the posts have been known to break in advance of the orthotic. This breakage results in an even shorter orthotic device life span. Also, posts have been known to separate from orthotic devices because of the difficulties involved in bonding the two materials which often results in incomplete bonding.

Semiflexible orthotics were first constructed of leather having an arch filled with a semicompressible material such as cork, sponge, or other like material, which contacted the arch of the shoe and thereby provided the necessary support. More recent designs of the semiflexible type were made from thermoplastics such as polypropylene or polyethylene. Commonly, the more recent semiflexible type of orthotic device had a uniform thickness in the range of 3.0 to 6.0 mm. As with the prior art rigid type, the semiflexible devices are also posted for purposes of correction and control. The material used for posting is of a dynamic or semicompressible type because of the flexible nature of the plate of the orthotic. There is, in the prior art, another version of the semiflexible orthotic, comprising a thin plate of thermoplastic (1.0–2.5 mm) which is supported by a semicompressible material similar to the leather types, relying again upon cushioned arch support provided by contact with the shoe.

The rigid type of orthotic, inherently affords the most positive control and is, therefore, preferred in many cases. The semiflexible orthotic devices, however, have the ability to provide quite satisfactory control in many cases where rigid control is not possible or desirable as often is the case when treating sports or geriatric patients. In the case of sports patients, especially casual sports patients, it should be noted that semiflexible devices are used not so much for their ability to flex but rather for their breakage resistance.

In accordance with the above, new and different rigid orthotic devices are desired which provide the material softness of the semiflexible type in combination with the basic rigidity of the rigid type of orthotic, but without the breakage associated with the latter type and without an attendant increase in overall thickness, weight, or bulk. Also, new and different semiflexible orthotic devices are desired which incorporate the above-stated features and allow for preselected areas of support and flexibility to provide greater latitude and more precision in their application.

Accordingly, an object of the present invention is to provide a rigid orthotic device which allows the use of a traditionally semiflexible material but which provides the rigidity of traditionally rigid orthotic devices.

Another object of the present invention is to provide an orthotic device, rigid or semiflexible, which is capable of being reinforced in preselected locations by a preselected amount.

Another object of the present invention is to provide a rigid orthotic device which has a relatively thin heel section to provide an enhanced fit and effectively lower the device within a shoe.

Another object of the present invention is to provide a rigid orthotic device which provides positive foot control but is flexible in noncontrol locations to result in a better fit within a shoe and provides a foot with a better and more comfortable fit.

Another object of the present invention is to provide a rigid orthotic device which includes integral front and rear posts.

Another object of the present invention is to provide a rigid orthotic device with increased resistance to breaking while providing desired rigidity.

Another object of the present invention is to provide a rigid orthotic device which allows for integral correction, adjustment, and variability in flexibility after the device has been dispensed.

Another object of the present invention is to provide a semiflexible orthotic device of reduced thickness and weight.

Another object of the present invention is to provide a semiflexible orthotic device which allows for selective areas of flexibility and selective areas of control.

Another object of the present invention is to provide a semiflexible orthotic device which provides improved foot control.

The above-stated objects and inherent advantages as well as those not stated but implied, in accordance with a fair reading and interpretation of this specification, the claims and drawings are intended to be included within the present invention as claimed and described.

SUMMARY OF THE INVENTION

The present invention accomplishes the stated and implied advantages and objects by providing rigid and semiflexible orthotics made from a polyolefin plastic material having a relatively thin constant thickness.

In one embodiment, strips of rods having a small cross-sectional area are heat welded to the base plate of the orthotic generally along the medial longitudinal length thereof in a direction parallel to the longitudinal axis. The amount and location of the strips are determined in accordance with the weight of the patient being fitted and in accordance with the amount and location of foot control required. Moreover, the reinforcing or control strips in the area of the medial arch portion are positioned so as not to contact the shoe when inserted therein. The same strips or extensions thereof may also be used for heel and forefoot postings.

In another embodiment, a first layer of a polyolefin plastic material is welded to a second layer of similar material but of preferably contrasting color. Both layers are thereafter shaped or formed in accordance with normal practices. The bottom layer in the areas of the forefoot and the rearfoot is then machine ground as required, producing any required posts. Then, the excess of the plantar layer is ground away using the color of the first layer of material as a guide as to the thickness removed and the thickness remaining. The arch of the orthotic remains the original thickness and, therefore, is substantial as compared to the remainder of the orthotic.

Various other objects, advantages and features of the invention will become apparent to those skilled in the art from the following discussion taken in conjunction with the following drawings, in which:

BRIEF DESCRIPTION OF THE DRAWINGS

FIG. 1 is an isometric view of the base plate of the inventive orthoses as laminated and prior to being formed or cut into its final shape;

FIG. 2 is an isometric view of the laminated plate of FIG. 1, formed and cut into a typical predetermined shape (to fit and control the foot of a particular person);

FIG. 3 is a plan view of the bottom of the orthoses of FIG. 2 with typical corrections after being ground;

FIG. 4 is a cross-sectional view of the orthoses of FIG. 3, taken along the line 4—4;

FIG. 5 is a cross-sectional view of the orthoses of FIG. 3, taken along the line 5—5;

FIG. 6 is a cross-sectional view of the orthoses of FIG. 3, taken along the line 6—6;

DESCRIPTION OF THE PREFERRED EMBODIMENTS

Figure 7:
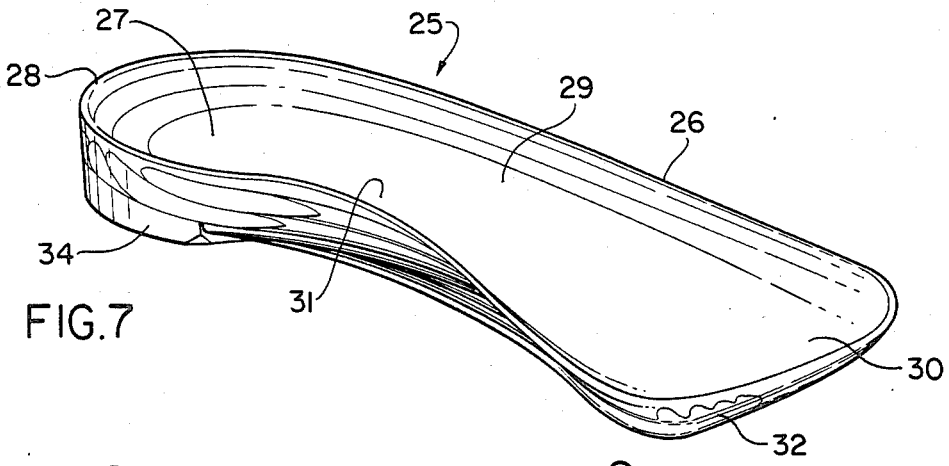
FIG. 7 is an isometric view of another embodiment of the inventive orthoses illustrating the top view thereof.

Referring now to the drawings, where like features among the various figures are designated by the same reference numeral. FIG. 1 illustrates the basic plate 10 from which the inventive orthosis is made. A top layer 11 of preferably colored, opaque polyolefin plastic, such as polypropylene, having a thickness of approximately 3.2 mm ($\frac{1}{8}$ inch), is heat bonded to a second layer 12. Layer 12 is also made from an opaque, polyolefin plastic such as polypropylene, but preferably of a different color than layer 11 and having a thickness oi approximately 4.8 to 6.4 mm (3/16 to $\frac{1}{4}$ inch). The total thickness of plate 10 is thus approximately 8.0 to 9.6 mm (5/16 to $\frac{3}{8}$ inch) and comprises a substantially homogeneous sheet of two different colors of a strong, tough, and semihard plastic.

Heat bonding of layers 11 and 12 is accomplished by heating the surfaces of the layers to be joined to their melting points. Then, the thinner layer 11 is applied onto the thicker layer 12, using an advancing and rolling technique so as to eliminate any possibility of air being entrapped between the two layers. It is to be noted that each layer is heated to its melting point only at the surfaces to be joined together. The remaining thickness of each layer is heated to its optimal forming temperature which is the point at which the material permanently reforms to a new configuration when so shaped. Prototype testing and shaping has revealed that each layer is to be heated to its melting point to a thickness approximating one-third to one-half of its thickness, while the remaining thickness is to be heated to its optimal forming temperature.

Plate 10 which is heated as described above, is then formed in a conventional manner, over a representation of a human foot such as a plaster impression of the person for whom the orthotic is being made, or a prefabricated mold for the purpose of general, noncustom usage, into the general shape of shell or form plate 13 shown in FIG. 2. The resulting shell or formed plate 13, thus has an upper surface which substantially coincides with the underside shape of the foot for which it is to be used. The portion generally designated 14 comprises the heel supporting region. The portion generally designated 15 comprises the forefoot supporting region which is sometimes also known as the metatarsal region. The center portion generally designated by the numeral 16 comprises the arch supporting region. As can be seen, a raised portion of the arch region 16 at the medial or inside section of shell 13 comprises the arch 17. A heel flange may be provided around the upper periphery of heel region 14 for purposes of closely fitting the contour of the heel of the person who will be using the orthotic and thereby providing a good supportive fit. The cross-sectional contours of arch 17 and heel flange 18 may be seen in FIGS. 4 and 6, respectively. In FIG. 4 it is seen that the arch 17 does not contact the inside of the shoe, The bottom surface of shell 13 is then machine ground, in the heel region 14 and the forefoot region 15, to the specific predetermined angles and thickness required to alter the function of the foot which has been previously determined to be needed to correct the foot problem of the ultimate user of the orthosis. The angles machined may, for example, correct excessive pronation experienced by the user when walking. This machining results in the "posts" 19 and 20 or heel and forefoot contact areas, generally located at the portions of the heel 14 and forefoot 15 regions, which contact the inside of the shoe and are provided substantially across the entire shoe as shown in FIGS. 5 and 6. The phantom lines in FIGS. 5 and 6 represent contour of the shoe within which the finished orthotic device 21 (FIG. 3) is inserted. FIGS. 5 and 6 also show the fit of posts 19 and 20 within and against the inside surface of the shoe as is generally typical with rigid orthotic devices.

The lower or bottom surface of shell 13 is further machine ground, while maintaining the required angles located at regions 14 and 15, which alter the function of the foot, until such time as the thickness remaining is slightly more than that required to adequately support the weight of the ultimate user of the particular orthotic which thickness is therefore predetermined for each orthotic. Such machining will occur primarily along the lateral or outside edge in the example shown in the drawings. The terms "outside" and "inside" as used herein refer to the edges of a person's foot which are commonly designated as the outside edge and the inside edge, with the inside edges of the feet being adjacent to each other. The machining may continue until upper layer 11 is exposed as shown in FIG. 3. The variation in colors of layers 11 and 12 facilitates this machining in that a visual reference is provided whereby it may be readily ascertained how much has been ground away. When the upper thinner layer 11 becomes exposed, the machining is substantially complete, although a slight amount of localized machining may be further performed as required. The net result is an orthotic 21 having a relatively thick and strong medial portion especially at the arch 17 where maximum stress occurs.

A further unique advantage is obtained in that the lateral portion of the orthotic 21 can flex to adapt to the lateral longitudinal shoe cant or shape, as shown in FIGS. 4, 5 and 6, reducing the incidence of rocking in the shoe commonly associated with rigid devices due to their uncompromising rigid nature in all areas.

The high fracture resistance properties of the polyolefin plastic of inventive orthotic 21 allows material thickness to be reduced in the heel 19 and forefoot 20 contact areas while maintaining proper rigid control of these areas by grinding the proper posting angles. The arch 17 of the inventive device is substantially thicker than prior art rigid devices to afford proper support. It should be noted that this arch 17, unlike prior art arch-filled devices, is designed not to contact the shoe and derives its strength solely from its thickness.

The inventive orthotic 21 shown in FIGS. 1 through 6, provide the additional following advantages:

The center of heel contact portion 19 has a relatively thin thickness (approximately 2 mm) which enhances fit of the foot at the heel portion 14 by effectively lowering the orthotic 21 in the shoe.

The contact portion of the forefoot 20, primarily the lateral forefoot area thereof, is relatively thin (approximately 2 mm) which enhances fit by effectively lowering the orthotic 21 in the shoe.

The rear foot or heel correction post 19 becomes integral with the heel portion 14 of the orthotic 21, unlike the required built up posts of the prior art, therefore precluding the possibility of breakage or separation of the post.

The forefoot posting portion 20, which also is integral with orthotic 21, likewise provides better control and breakage resistance of the posting.

The thicker arch 17 provides arch support equivalent to prior art rigid devices while retaining the ability to "spring" to some degree. Additionally, the inventive orthotic has control over the spring or flex in different areas of the same device.

The inventive orthotic 21 allows the use of "soft" plastics with a rigid orthotic which previously could only be used with semiflexible orthotics. This softness materially aids in wearer comfort. Also, the "softer" appearance of this material "softens" the look of the device and increases user acceptance.

The inventive rigid orthotic 21, which is made from polyolefin plastic, is almost unbreakable and is substantially less breakable than the plastics from which the prior art rigid orthotics were made.

The finished orthotic 21 can be further custom fit to the wearer's foot, or additional flexibility can be provided, by additional machining, the amount of which can be readily discerned by the visual effect provided by the different colors of the layers 11 and 12.

The finished orthotic 21 can be easily modified or corrected, if it is too weak or flexible, by heat welding additional material to the device wherever it is needed. This may be accomplished as stated above with regard to the joinder of layers 11 and 12, or as stated below, with regard to the strips 32 heat welded to the shell of the orthotic. This was not possible in the prior art.

Figure 8:
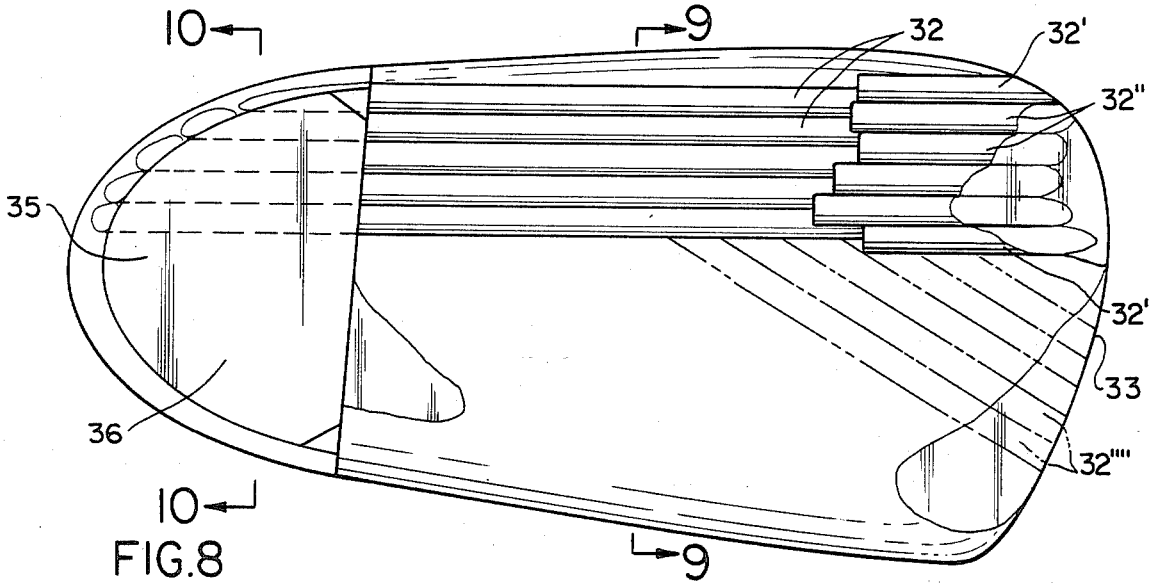
FIG. 8 is a bottom view of the orthotic of FIG. 7, illustrating the location and form of the reinforcement.
Figure 9:
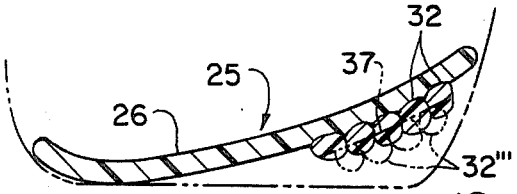
FIG. 9 is a cross-sectional view of the arch portion of FIG. 8, taken along the line 9—9.

A semiflexible orthotic device 25, made in accordance with the invention, is shown in FIGS. 7, 8, and 9. Orthotic 25 is preferably made from a single plate, sheet, or layer of a polyolefin plastic having a thickness of approximately 3.2 mm ($\frac{1}{8}$ inch). As with the orthotic 21 described above, orthotic 25 is formed over a representation of a human foot such as a plaster impression of an actual foot or a prefabricated mold. A resulting semiflexible shell or formed plate 26 having a uniform thickness is thus formed. The resulting upper surface of shell or formed plate 26 thus substantially coincides with the underside shape of the foot of the person for whom it is to be used. Shell 26 includes heel portion 27, heel flange 28, arch portion 29, and forefoot portion 30.

A plurality of strips of plastic 32, such as a polyolefin, are heat welded to the plantar or underside of shell 26, generally along the medial or inside portion thereof. Strips 32 may extend from the end 33 of the forefoot portion 30, which end may be located at the proximal aspect of the second metatarsal head of the user's foot, to the posterior medial aspect of the calcaneus of the user's foot, as shown in FIG. 8. Strips 32 may be circular in shape having a solid cross-sectional diameter of approximately 3.2 to 4.8 mm ($\frac{1}{8}$ to 3/16 inch). Strips 32 are preferably welded to each other and to shell 26 in a side-by-side array, as shown in FIGS. 8 and 9. The actual number of and size of strips 32 used is dependent upon the degree of shell 26 flex desired or conversely, the amount of rigidity desired to be added to shell 26. Strips 32 are preferably welded to the medial side of shell 26 because of the presence of the arch 31 which is to be reinforced and because posting is generally applied to the medial side. However, all or any part of one or more strips may be welded to any part of the underside or plantar surface of shell 26 in accordance with the predetermined degree and location of plate (shell) flex or rigidity desired, or for posting purposes. For example, a portion of several strips 32'''' may be applied to the lateral side of the forefoot portion 30 for posting purposes as shown in phantom in FIG. 8. And, several short strips 32' may be applied to the medial and lateral sides of the forefoot portion 30 of strips 32 in order to further provide posting contact area.

Figure 10:
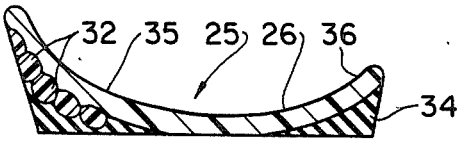
FIG. 10 is a cross-sectional view of the heel portion of the orthotic of FIG. 8, taken along the line 10—10.
Figure 11:
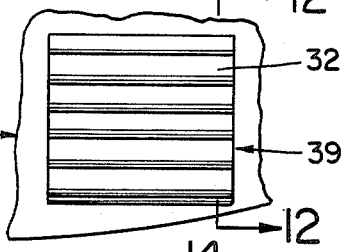
FIG. 11 is a bottom view of a portion of a typical orthotic, illustrating one form of a post as contemplated by the invention.

As shown in FIG. 10, a semicompressible material comprising a heel cushion 34, such as styrene butadiene rubber, having a thickness of approximately 12.8 mm (½ inch) may be cemented to the underside of heel portion 27 over the portion of strips 32 existing at this portion. The strips 32 at the plantar side of forefoot portion 30 and the cushion 34 at the plantar side of heel portion 27 are then machine ground to provide the required correction or altering of the foot function as described above and with respect to the rigid type of orthotic 21. The forefoot correction or posting is ground directly into the forefoot portion of plastic strips 32. Should additional correction be required, for example, should a greater degree of angulation be required, additional strips of plastic 32'' may be heat welded to the forefoot portion 30 at the medial part thereof in order to build up this portion. The rearfoot posting is ground into the heel cushion 34 and into the rearfoot portion 35 of strips 32 extending thereunder. The rearfoot correction, then, is a combination of the compressible material 34 at the lateral side 36 of heel portion 27 and the noncompressible plastic strips and the compressible material 34 at the medial side 35 of heel portion 27. The combination rearfoot post may be seen in cross section in FIG. 10.

It is to be noted that although orthotic 25 is a semiflexible device which in the past included the use of a cushioned material between the entire underside of the orthotic and the inside of the shoe (shown in phantom) to which it is fitted for support, the inventive, semiflexible orthotic 25 does not contact the inside of the shoe at the medial arch 31 of arch portion 29—see FIG. 9. The strength of the orthotic 25 provided by strips 32 allows such noncontact. Should additional strength or further reinforcement be required, additional strips 32''' shown in phantom may be applied. The semiflexible nature of orthotic 25 is, therefore, controlled by the combination rigid and cushioned heel post, the reinforced arch, and the rigid forefoot post.

Orthotic 25, of course, may be further customized after fabrication by the addition of more full length or partial length strips 32, or further grinding of strips 32 in locations where such customization is required. This allows the orthotic to be even more custom fit to the user.

The advantages obtained by the inventive, semiflexible orthotic 25 also include the following:

The reduced thickness of shell 26—as compared to prior art semiflexible plates—and the localized added material (strips 32, 32', 32'', 32''', and 32'''') provide more than adequate stiffness to orthotic 25 while reducing the overall weight of the device as compared to the prior art semiflexible orthotics.

The addition of material (strips 32, 32', 32'', 32''', and 32'''') to selected locations in the amount desired provides a semiflexible orthotic 25 having the degree of stiffness where desired and the degree of flexibility where desired, thereby allowing very individualized orthotics.

An orthotic capable of being individualized as regards stiffness and flexibility as shown and described, provides a semiflexible orthotic 25 having improved foot control and foot cooperation characteristics.

Utilization of the hithertofore unused portion of the arch 31 for flexibility control in combination with suspended foot support provides a semiflexible orthotic 25, without the attendant problems associated with arch support achieved by contact with a shoe.

Utilization of an integral forefoot post (by welding strips 32 to shell 26) provides a substantially unbreakable post and one which cannot separate from shell 26. The integral forefoot post provides rigid, noncushioned contact with a shoe. This feature provides improved control of the forefoot and midtarsal joint. However, a cushion may be applied to the integral post if needed. Thus, the invention allows a choice of either cushioned or noncushioned forefoot posting.

The integral forefoot posting provides the good fit previously achieved in the prior art by a method whereby the tip of the orthotic is bent during the molding process but which undesirably "flexs out" when used on semiflexible orthotics. The inventive semiflexible orthotic 25 provides a good fit but precludes flexing out due to the positive stop provided by the forefoot portion of the reinforcing strips 32.

The rearfoot or heel posting of the prior art semiflexible orthotic most commonly utilized a dynamic or cushioned support across the entire heel portion which was used for purposes of shock absorption when the rearfoot strikes the ground. However, the prior art heel portion generally does not consider the medial side of the heel portion which is responsible for controlling subtalar or rearfoot pronation after heel contact and as the rearfoot rotates inward. Because the prior art rearfoot post has the greatest thickness at the medial side and because of the dynamic nature of the same, a lack of rearfoot control occurs, especially over time as material begins to take on a permanent compression. Also, an increase in the flexibility of the post, causes a more pronounced lack of rearfoot control. The inventive semiflexible orthotic 25 provides for dynamic response and controls the rearfoot pronation after heel contact as a result of the combination rigid and cushioned heel post. As explained above, both the cushioned support 34 and the rearfoot portion of strips 32 are machined to provide the correct angulation of the rearfoot post as shown in FIG. 10.

The inventive semiflexible orthotic 25 provides for additional customizing after fabrication to a degree never before achievable. The customizing after fabrication consists primarily of raising and lowering the arch and/or increasing or decreasing the flexibility of the orthotic. In the prior art, as with the inventive device, spot heating can be used to raise or lower the arch. The raising of the arch, however, causes a decrease in the flexibility of the orthotic; conversely, the lowering of the arch causes an increase in the flexibility of the orthotic. In the prior art, it was required to live with the resulting decreased flexibility (increased rigidity) because no adequate means or method existed to thereafter increase the flexibility of the orthotic. An increase in flexibility was "compensated" for by adding a cushioned material to the medial arch relying on the cushioned contact with the shoe to achieve the desired result of decreasing the flexibility. This solution, however, is not satisfactory because it substantially increases weight and bulk within the shoe; and, due to the nature of the cushioning material, the amount of rigidity added is imprecise. The inventive device 25 provides for additional reinforcing strip(s) 32 along the medial arch 31 to accomplish a decrease in orthotic flex by materially strengthening the orthotic by a precise amount, with much less additional weight and without contacting the shoe, thereby avoiding the aforementioned disadvantages. In the prior art, as noted, there has been no effective means of increasing the flexibility of a constant thickness, semiflexible orthotic. The inventive orthotic 25 may accomplish this increase in flexibility simply by reducing the thickness of the strips 32 through grinding, such as to the phantom line 37 in FIG. 9, without affecting the functional integrity of the device.

The inventive orthotic 25 can be readily tuned to the individual patient or user after being manufactured by the nondestructive addition or removal of material (by adding additional strips 32 or grinding the existing strips 32). Furthermore, a very broad range of fine tuning is possible, while not materially affecting the fit within the shoe or structural integrity of the orthotic 25. These features greatly enhance the suitability of the inventive semiflexible orthotic 25 for custom or prescription use.

Figure 12:
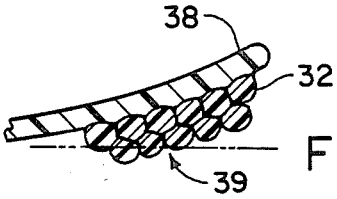
FIG. 12 is a cross-sectional view of the post of FIG. 11, taken along the line 12—12.

FIGS. 11 through 14 show additional means for posting either or both of the embodiments 13 and 25 of the inventive orthotic. In FIG. 12, which represents either the heel or the forefoot portion of an orthotic 38, a plurality of strips 32 are heat welded to the underside of orthotic 38, which may be either a semiflexible orthotic 25 or a rigid orthotic 13. Strips 32 and orthotic 38 may be made from a polyolefin plastic. Strips 32 may, as previously noted, be round, square, or rectangular in cross section and may be of an appropriate size. One or more layers of strips 32 may be applied in order to achieve the necessary height or thickness of the resulting post 39, which may comprise either a heel post or a forefoot post. Strips 32 may be ground after welding to achieve the proper angulation and further adjust the thickness of post 39. Furthermore, additional strips 32 may be applied to increase the area of post 39 as required to achieve adequate support.

Figure 13:
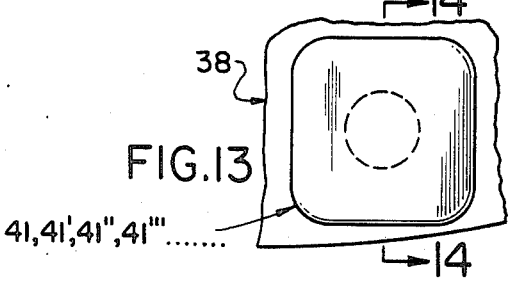
FIG. 13 is a bottom view of a portion of a typical orthotic, illustrating another form of a post as contemplated by the invention; and, FIG. 14 is a cross-sectional view of the post of FIG. 13, taken along the line 14—14.
Figure 14:
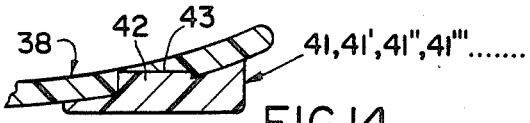

In FIG. 13, a removable post 41 is applied to orthotic 38. Post 41 may again comprise either a heel post or a forefoot post. Post 41 is secured to orthotic 38 by means of the fit between the round member 42, which extends from plate member 43, and hole 43 in orthotic 38. The fit between member 42 and hole 43 may be a slight press fit which allows relatively easy removal and reinsertion of post 41. Or, removal of post 41 and the reapplication of another post of a different size, thickness, or angulation. Thus, a number of different posts 41, 41', 41'' . . . 41''', may be used with orthotic 38 which, as previously stated, may comprise a rigid orthotic 13 or a semiflexible orthotic 25. This degree of versatility allows for custom fitting of an orthotic without consideration of posting requirements. After fabrication of orthotic 38, the prescribing physician or the maker of the customized orthotic may apply a post 41 to orthotic 38, chosen from a large variety of posts 41', 41'' . . . 41''', which may be prefabricated and may be on hand to finally and properly fit orthotic 38 to the wearer. Orthotic 38 may also comprise one of a number of noncustomized orthotics made in accordance with the embodiment of the figures, having standard shapes and sizes which also are prefabricated and on hand. In this manner, the number of prefabricated and noncustomized orthotics required to be on hand may be greatly reduced while providing a greater variety and thereby a better fit of noncustomized orthotics is achieved.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim as my invention:

1. An orthotic for supporting a human foot within a shoe and controlling the motions of the foot comprising a formed plate having an upper surface having a shape substantially coinciding with the underside shape of said foot, an inside arch portion suspended so as to not contact the inside of the shoe and means integral with said formed plate for variably altering the flexibility of any portion of said formed plate while substantially maintaining the rigidity of the suspended arch portion.

2. The orthotic of claim 1, wherein said formed plate comprises a first layer and a second layer of a formable material said first layer being above said second layer and whereby said layers are joined together.

3. The orthotic of claim 2, wherein said layers are made from a polyolefin plastic.

4. The orthotic of claim 2, wherein said layers are made of a material of different colors.

5. The orthotic of claim 2, wherein said integrally joined layers are heat welded together.

6. The orthotic of claim 2, wherein said orthotic comprises a heel portion at one end, a forefoot portion at the other end, and arch portion therebetween, said arch portion having an inside portion comprising a raised arch, said portions corresponding to such portions of said foot, said orthotic being adapted to fit against a supporting member at said heel portion and at said forefoot portion, said means for variably altering the flexibility of any portion of said formed plate comprises the thickness of said second layer and whereby said second layer having a variable thickness.

7. The orthotic of claim 6, wherein the thickness of said second layer ranges from a minimum thickness at the outside of said arch portion to a maximum thickness at the inside of said arch portion with said maximum thickness being located at said raised arch and said inside and outside corresponding to the inside and outside of said foot.

8. The orthotic of claim 6, wherein the thickness of said second layer ranges from zero at the center of said heel portion to a maximum at the approximate periphery thereof.

9. The orthotic of claim 6, wherein the thickness of said second layer at the forefoot portion thereof ranges from a minimum at one side portion thereof to a maximum at the other side portion thereof, said side portions corresponding to the inside and outside portions of said foot.

10. The orthotic of claim 6, wherein said second layer varies in thickness from a minimum at the outside portion thereof to a maximum at the inside portion thereof along the longitudinal length thereof with said inside and outside portions corresponding to the inside and outside of said foot.

11. The orthotic of claim 7, wherein the thickness of said second layer at said arch portion ranges from a minium thickness of zero to a maximum thickness of approximately one-quarter of an inch.

12. The orthotic of claim 8, wherein the thickness of said second layer at said heel portion ranges from a minimum thickness of zero to a maximum thickness of approximately one-quarter of an inch.

13. The orthotic of claim 9, wherein the thickness of said second layer at said forefoot portion ranges from a minimum thickness of zero to a maximum thickness of approximately one-quarter of an inch.

14. The orthotic of claim 8, wherein the thickness of said second layer ranges from a minimum thickness of zero to a maximum of approximately one-quarter of an inch.

15. The orthotic of claim 6, wherein said heel portion includes a heel post comprising the layers of said formed plate machined to a predetermined thickness and angle at the location of said heel portion.

16. The orthotic of claim 6, wherein said forefoot portion includes a forefoot post comprising the layers of said formed plate machined to a predetermined thickness and angle at the location of said forefoot portion.

17. The orthotic of claim 1, wherein said formed plate comprises a single layer of a formable material.

18. The orthotic of claim 17, wherein said formable material comprises a polyolefin plastic.

19. The orthotic of claim 17, wherein said orthotic comprises a heel portion at one end, a forefoot portion at the other end, and an arch portion therebetween, said arch portion having a raised arch located at the inside portion thereof, said portions corresponding to such portions of said foot, said orthotic being adapted to fit against a supporting member at said forefoot portion and at said heel portion.

20. The orthotic of claim 19, wherein said means integral with said formed plate for variably altering the flexibility of said formed plate comprises one or moe strips of a suitable material integrally connected to the underside surface of said formed plate along the inside portion thereof.

21. The orthotic of claim 20, wherein said one or more strips of material comprise a polyolefin plastic which is heat welded to said formed plate along the longitudinal length thereof.

22. The orthotic of claim 21, wherein said one or more strips comprise a predetermined number of strips having a predetermined cross-sectional shape whereby a predetermined decrease in the flexibility of said formed plate is achieved.

23. The orthotic of claim 20, wherein said forefoot portion includes a forefoot post comprising said one or more strips of material located at said forefoot portion, machined to a predetermined thickness and angle.

24. The orthotic of claim 20, wherein said heel portion includes a heel post comprising said one or more strips of material located at said heel portion, machined to a predetermined thickness and angle.

25. The orthotic of claim 6, including means for removably connecting a post to said heel portion or to said forefoot portion.

26. The orthotic of claim 25, wherein said post comprises a plate having a predetermined thickness and a predetermined angle between the lower and upper surfaces of said plate, a connecting member protruding from said upper surface and an opening in said formed plate for receiving said connecting member so as to connect said post to said formed plate.

27. The orthotic of claim 19, including means for removably connecting a post to said heel portion or to said forefoot portion.

28. The orthotic of claim 27, wherein said post comprises a plate having a predetermined thickness and a predetermined angle between the lower and upper surfaces of said plate, a connecting member protruding from said upper surface and an opening in said formed plate for receiving said connecting member so as to connect said post to said formed plate.

29. The orthotic of claim 6, wherein the thickness of said second layer at the forefoot portion thereof is substantially of a constant thickness from the inside to the outside thereof.

* * * * *